US005590427A

United States Patent [19]

Weterings et al.

[11] Patent Number: 5,590,427

[45] Date of Patent: Jan. 7, 1997

[54] SHOWER SITTING STRUCTURE

[75] Inventors: Wilhelmine M. M. Weterings, Raamsdonkveer; Franciscus J. M. Nieuwenhuis, Gouda; Willem G. L. de Jong, Pijnacker, all of Netherlands

[73] Assignee: B.V. Linido, Pijnacker, Netherlands

[21] Appl. No.: 199,124

[22] PCT Filed: Jan. 15, 1993

[86] PCT No.: PCT/NL93/00015

§ 371 Date: Mar. 14, 1994

§ 102(e) Date: Mar. 14, 1994

[87] PCT Pub. No.: WO93/13702

PCT Pub. Date: Jul. 22, 1993

[30] Foreign Application Priority Data

Jan. 16, 1992 [NL] Netherlands ..... 9200074

[51] Int. Cl.[6] ..... A47K 3/12

[52] U.S. Cl. ..... 4/611; 4/604; 4/578.1

[58] Field of Search ..... 4/611, 571.1, 573.1, 4/574.1, 575.1, 578.1, 589, 590, 604; 297/14

[56] References Cited

U.S. PATENT DOCUMENTS

| | | | |
|---|---|---|---|
| 2,589,592 | 3/1952 | Ocana | 4/590 |
| 2,965,153 | 12/1960 | Purcell, Sr. | 4/578.1 |
| 3,196,465 | 7/1965 | Montgomery | 4/578.1 |
| 4,052,087 | 10/1977 | Gagliardi | 4/571.1 |
| 4,253,203 | 3/1981 | Thomas | 4/611 |
| 4,391,006 | 7/1983 | Smith | 4/611 |
| 4,727,606 | 3/1988 | Cavey et al. | 4/611 |

FOREIGN PATENT DOCUMENTS

| | | | |
|---|---|---|---|
| 2405599 | 8/1975 | Germany | 4/611 |
| 13275 | of 1905 | United Kingdom | 4/573.1 |
| 2119241 | 11/1983 | United Kingdom | 4/575.1 |
| 2149299 | 6/1985 | United Kingdom | 4/611 |
| 2213368 | 8/1989 | United Kingdom | 297/14 |

*Primary Examiner*—Henry J. Recla
*Assistant Examiner*—Charles R. Eloshway
*Attorney, Agent, or Firm*—Louis E. Marn

[57] ABSTRACT

Shower sitting structure (1) comprising a frame and seat support elements (2, 3) forming seat support surfaces for supporting a user's body, in which the seat support elements (2, 3) are designed in such a way that support is present only under the thighs in front of the ischial tuberosities, in which there is no support at the position of the perineum, and in which a backrest element (3), which at its bottom end forms a supporting part (38), for the lower back region of the user is present.

4 Claims, 3 Drawing Sheets

SHOWER SITTING STRUCTURE

The invention relates to a shower sitting structure, comprising a frame and seat support elements forming seat support surfaces for supporting a user's body, in which the seat support elements comprise two thigh supporting parts disposed symmetrically on either side of a vertical plane and having rear regions and front regions, the front regions being designed to support parts of the user's thighs nearer the knee, and the seat support elements being formed in such a way that in the region where the user's buttocks will lie during use, they form an essentially horizontal free passage from back to front to the perineum, the structure further comprising a back support element for the back regions of a user. Such a shower sitting structure is known from U.S. Pat. No. 3,730,590 and is intended in particular for users who have one or more physical disabilities as a result of illness or age, and require a support temporarily or all the time while they are taking a shower.

The abovementioned users can be old people or people suffering from diseases such as rheumatism, Parkinson's disease, multiple sclerosis, paraplegia, muscular diseases, hemiplegia etc., or people who have become handicapped as the result of an accident. Many of these users can stand up only for a short time, or cannot stand at all, and will therefore have to take their shower sitting down. Other users need a shower seat support only for certain actions, and for yet other users the seat support is not necessary, but it can provide a comfortable rest point while taking the shower. By sitting on a shower seat support, the users, who are often limited in their movements through a handicap or age, will be more likely to be able to carry out certain washing operations themselves, which gives them a greater sense of well-being and also means that there is less call for a carer.

One problem connected with the use of a seat support when taking a shower is that the parts of the body on which the user is resting are less accessible for washing. A carer is therefore more likely to be needed to give assistance in the washing.

The shower sitting structure shown in U.S. Pat. No. 3,730,590 is provided with straight, flat and apparently hard elements which extend until under the buttocks and the ischial tuberosities, thereby leading to high, unpleasant pressures.

The object of the invention is then to provide a shower sitting structure which produces an improvement here and increases the user's ability to help himself.

That object is achieved by having a shower sitting structure being characterized in that the back support element at its bottom end forms a supporting part for the region of the user's back in the vicinity of the sacrum, in that the rear regions of the thigh supporting parts form the rear edges of the seat support surfaces and in that the rear regions of the thigh supporting parts extend up until short of the buttocks and do not extend under the ischial tuberosities of a user.

These measures make taking a shower a more pleasant experience for the user, while fewer actions are needed by user or carer.

The rear regions of the thigh supporting parts preferably form the rear edges of the seat support surfaces. This means that the user's bottom will, as it were, stick out backwards from the thigh supporting parts, so that virtually all of the buttock area is simple to reach from behind and from the sides. In this case, it is very advantageous if the seat supporting elements are formed in such a way that their seat support surfaces leave the ischial tuberosities of the user free, so that these places are also easily accessible and cannot be subjected to high, unpleasant pressures.

The back support element being in the region of the sacrum means that the user, with his thighs resting on the seat support surfaces, will experience greater sitting stability, which prevents the user from being able to slide too far back, and his pelvis from being able to tilt backwards.

The seat support surfaces of the thigh supporting parts in the rear regions and in the front regions preferably form an obtuse, downward opening angle of 160°–180°, while the front regions of the seat support surfaces of the thigh supporting parts lie essentially horizontally. The horizontal surfaces provide a surface which makes it easy for the user to sit down and get up, or to slide onto the seat or slide off it during transfer. The backward sloping rear regions ensure greater sitting stability, in particular if the abovementioned sacrum support is present.

Preferably the seat support elements in top view can assume an essentially U-shaped form which opens towards the back. This gives the user maximum accessibility to the pubic area. In this case the transverse connection lying at the front not only reinforces the structure, but also forms an additional supporting surface, which facilitates transfer of the user, i.e. sitting down or getting up again. It is also easier to slide people from a wheelchair onto the present seat unit, and vice versa. In addition, it prevents a leg from becoming stuck in the case of persons whose legs are subject to uncontrolled movements, such as spastic patients or paraplegics.

According to another preferred embodiment of the shower sitting structure according to the invention, the thigh supporting parts merge into each other at the position of the vertical plane. The thigh supporting parts in this case preferably form part of an elongated seat support extending at right angles to the vertical plane. The rear and front regions of the thigh supporting parts further preferably form a surface which is cylindrical or elliptical when viewed in cross-section of the elongated seat support.

In the latter case a sacrum support is also preferably present, in which case the seat support and sacrum support can both be elongated and cylindrical and extend parallel to each other.

Since the shower seat unit according to the invention is intended particularly for placing in the user's own home, it is also advantageous if the shower seat unit contains means, preferably hinge means, for folding up the seat support elements.

The invention will now be explained in greater detail with reference to a number of preferred embodiments, which are shown by way of example in the accompanying drawing, in which.

Figure 1:
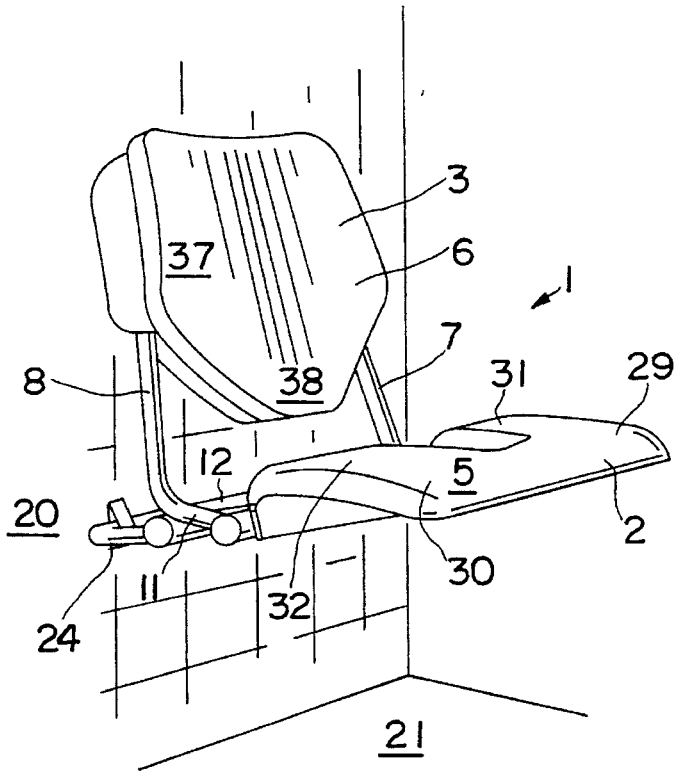
FIG. 1 is a view, at an angle from the front and from the side, of a first embodiment of the shower sitting structure according to the invention, shown in the position ready for use.
Figure 2:
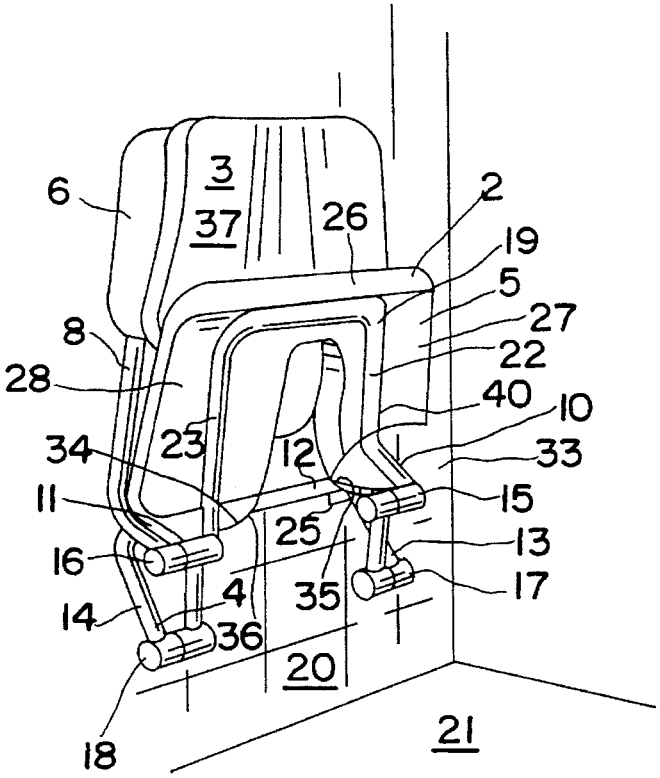
FIG. 2 shows the shower seat of FIG. 1, folded up.

The shower seat 1 of FIGS. 1 and 2 comprises a U-shaped seat support 2, a backrest 3 and a fixing bracket 4. The seat support 2 is mounted freely suspended above the floor 21, and comprises a U-shaped bracket 19, of which the legs 22 and 23 extending backwards (FIG. 1) or downwards (FIG. 2) are hingedly connected to the fixing bracket 4 at the position of hinges 15 and 16, and are hingedly connected to the back rest 3 at the position of hinges 17 and 18. A seat part 5, which will be discussed further below, is fixed to the bracket 19.

The backrest 3 comprises two bars 7 and 8, which at their fixed top end (not shown) are hingedly connected to the wall 20, and at their bottom end are bent over to a more horizontal position by means of end parts 10 and 11, which at the position of hinges 15 and 16 mentioned earlier are hingedly connected to the U-shaped bracket 19 of the seat support 2. A back part 6, which will be described in further detail below, is fixed on the bars 7 and 8.

The fixing bracket 4 is U-shaped and has a bar 12 which extends along the wall 20 and is bent over at right angles at both ends to end parts 13 and 14, which at their ends, at the position of the hinges 17 and 18 mentioned earlier, are hingedly connected to the U-shaped bracket 19 of seat support 2. The bracket 4 is hingedly fixed to the wall 20 by means of bar 12 at the position of fixed hinges 24 and 25.

It can be seen in FIG. 2 that the shower seat can be folded up to a position which takes up little space. During the folding up the bracket 4 is forced to turn downwards about hinges 24 and 25, through the fact that the hinges 15 and 16 remain relatively in position in the vertical direction. However, through the hinged fixing of the top ends of the backrest bars 7 and 8, the hinges 15 and 16 will be able to move to some extent towards wall 20, in which case the backrest is forced into a position nearer the wall. In the folded-up position the seat support 2 is almost vertical, which position it can retain by itself. When the shower seat is to be used, the seat support 2 is simply gripped with the hand and folded downwards. The movements and displacements described above then take place in reverse downwards through the fact that the top side of the hinges 17 and 18 in the correct position of the seat support 2 comes to rest against the bottom side of the end parts 10 and 11 of the backrest bars 7 and 8. Alternatively or in addition, suitable rotation limiters can be provided in the hinges 15, 16, 17 and 18.

The seat part of the seat support 2 is also U-shaped, opening backwards (seen in FIG. 1), and is provided with a groove 40 in which the bracket 19 is clamped. The seat part 5 comprises a transverse element 26 and two leg elements 27 and 28, which are made in one piece of plastic such as polyurethane foam with closed skin. At the body-supporting side the leg elements 27 and 28 of the seat part 5 comprise front supporting surfaces 29 and 30 and rear supporting surfaces 31 and 32 connecting thereto. The rear edges 33 and 34 of the rear supporting surfaces 31 and 32 also form the rear end of the seat part 5. The position of the rear edges 33 and 34 is selected in such a way that the user is supported with his weight almost entirely on the underside of his thighs, and his buttocks are thus essentially free from contact with the support. In order to ensure that the ischial tuberosities will also remain free, the rear edges 33 and 34 are bevelled on the inside at the position of 35 and 36. Owing to the fact that there is essentially no buttock support and owing to the fact that the rear end is open, the buttock area and the region of the perineum of the user are very easily accessible from the back and from the sides. The absence of any transverse connecting part in the seat support 2 below the region where the buttocks of the user will lie means that excellent accessibility from below is also provided.

The back part 6 comprises an element 37 for supporting the back, in particular the lumbar vertebrae, at its lower end ends in a sacrum support 38 formed integrally therewith. The element 37 is preferably made of the same material as the seat part 5.

Figure 3:
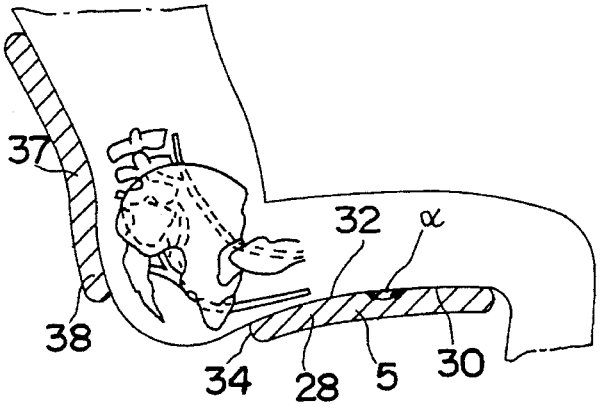
FIG. 3 is a diagrammatic illustration of the shower seat of FIGS. 1 and 2, partially cut away, showing diagrammatically the user in a seated position.

FIG. 3 shows diagrammatically the way in which a user can be seated comfortably on the shower seat of FIGS. 1 and 2. The thighs are supported on front and rear surfaces 30, 32 of seat part 5. The surfaces 30 and 32 form an angle $\alpha$ of 160°–180°, in this case approximately 167°, with each other. The seat part stops at the position of the rear edge 34, thus leaving the buttocks of the user completely free behind that. The support of the user is completed by the backrest 37, in particular the sacrum support 38. The user, who in this way can sit down with his back free from the backrest, in the position shown can lean back in a relaxed way, while he is reliably prevented from being able to slide with his buttocks too far back, and from then sinking down too far into an uncomfortable position.

The user or the carer can easily reach the buttocks and the region of the perineum by moving the hand from back to front and/or upwards. Moreover, the fact that the opening between the thigh supports is continued fairly far forward means that the user's pubic area is also easy to reach from the front.

Figure 4:
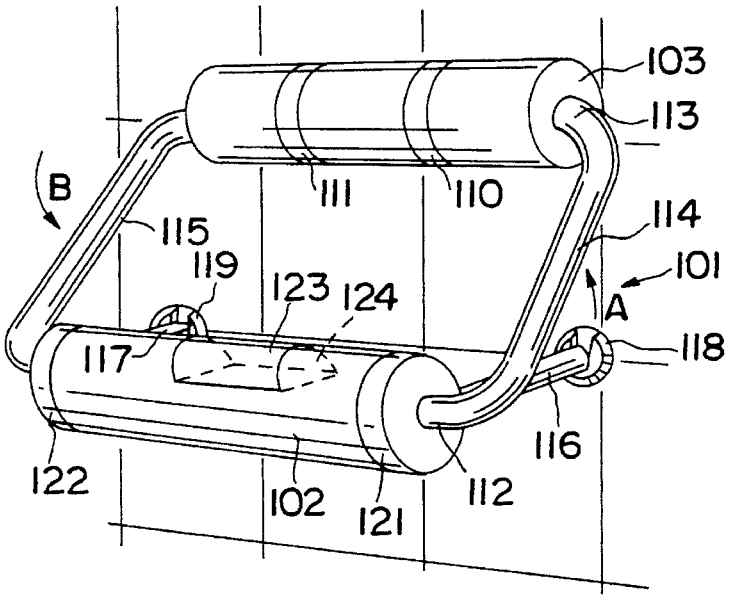
FIG. 4 is a view, at an angle from the front and from the side, of a second embodiment of the shower seat according to the invention.
Figure 5:
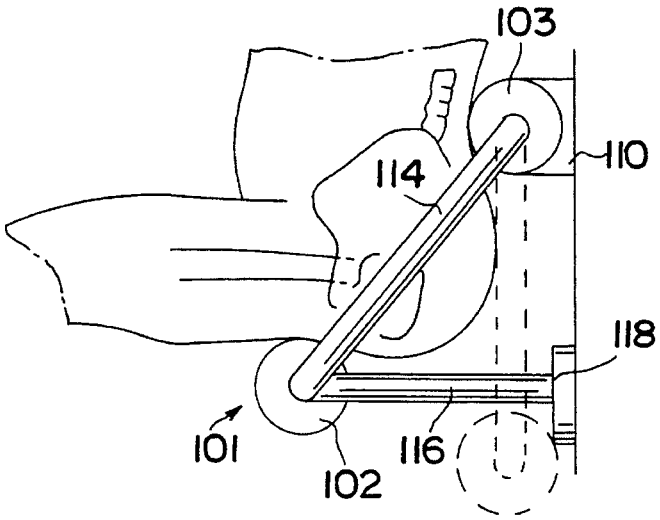
FIG. 5 is a side view of the shower sitting structure of FIG. 4, in which the user is shown diagrammatically.

The second embodiment of the shower seat according to the invention, shown in FIGS. 4 and 5, is intended more for users who are less incapacitated with physical disabilities and are able to wash without assistance from a carer, but who will still need a support in order to rest and/or to enable them to wash in a stable position.

The shower seat 101 comprises an essentially rectangular tubular frame 112, 113, 114, 115 with rounded corners, of which the bottom, horizontal tubular part 112 is surrounded by a seat support roll 102 of, for example, polyurethane foam with closed skin, and the top tubular part 113 is surrounded by a backrest roll 103 of, for example, the same material as the seat support roll 102. Other suitable materials for the seat support roll 102 are ABS, polypropylene and polyethylene. In general, the usual plastic materials, both in rigid and in flexible form, can be used for this. The backrest roll 103 is clamped to the wall 120 at the position of 110 and 111. In the description which follows the shower seat is illustrated, by way of example, as being collapsible. In this case the tubular part 113 is accommodated so that it rotates in the roll 103. The seat support roll 102 is clamped at both ends at the position of 121 and 122 to support tubes 116 and 117, which are themselves fixed at the position of 118 and 119 to the wall 120. The seat support roll 102 is also rotatable relative to the tubular part 112. The fastenings 118 and 119 are designed in such a way that the support tubes 116 and 117 can be detached in a simple way by their end lying near the wall, so that the support tubes 116 and 117 can subsequently be rotated with the seat support roll 102 in the direction of the arrow A. At the same time the frame 112, 113, 114, 115 will rotate inside the back support roll 103 in the direction of the arrow B. The length of the support tubes 116, 117 is so much shorter here than the distance between the two rolls 102 and 103 that the ends of the support tubes 116 and 117 can fall inside the frame when the frame parts 114 and 115 are essentially vertical, so that the shower seat 101 takes up hardly any space when collapsed. This is shown by dashed lines in FIG. 5.

In the side view of FIG. 5 it can also be seen how a user can be seated on the shower seat 101. The user sits with his rear lower thigh regions on the seat support roll 102, the front and rear supporting surfaces of which virtually coincide with each other. The backrest roll 103 makes contact with the user 1 in the lower lumbar or even sacral region. The whole area from sacrum to thighs is consequently free and is easily accessible for the user's hand. Without reducing sitting stability, the user can move to a slightly bent position, in order to force the buttocks back a little more, so that in this way the gap between the buttocks is widened and is made more easily accessible. The seat support roll 102 is shown here with a removable, semi-cylindrical element 123, which on removal leaves a slit 124 in the seat support roll 102. The length of the slit 124 is such that the pubic area of the user is easy to reach, and the genitals of male users are prevented from becoming trapped.

Figure 6:
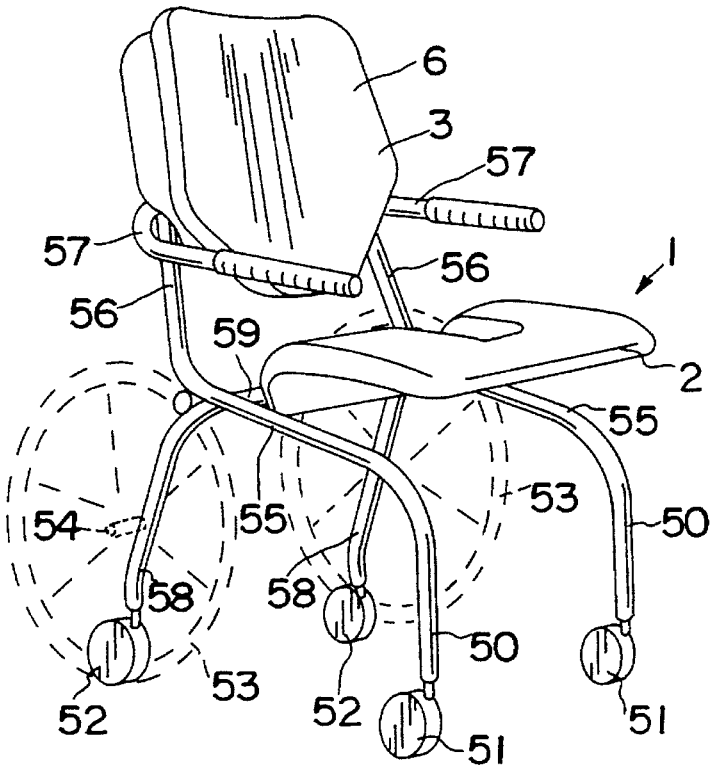
FIG. 6 shows an alternative, mobile embodiment of the shower seat of FIG. 1.

The shower seat of FIG. 6 corresponds essentially to the shower seat 1 shown in FIGS. 1–3, the main difference being that the shower seat is provided with front legs 50 which are provided with castors 51, and rear legs 58 which are provided with castors 52, or alternatively with spoked wheels 53 (shown in dashed lines), which are rotatably fixed by their axles 54 to rear legs 58. The front legs 50 merge at their top end into backward running tubes 55, which at the back are again bent upward to merge into essentially vertical tubes 56, on which the back part 6 is fixed. Extending from the rear side of the back part 6 are two arm rests 57, which are fixed to the tubes 56. The rear legs 58 with the connecting tube 59 form a U-shaped unit which is fixed directly or indirectly to the tubes 55. The seat rest 2 is fixed at the rear side to the tube 59.

Figure 7:
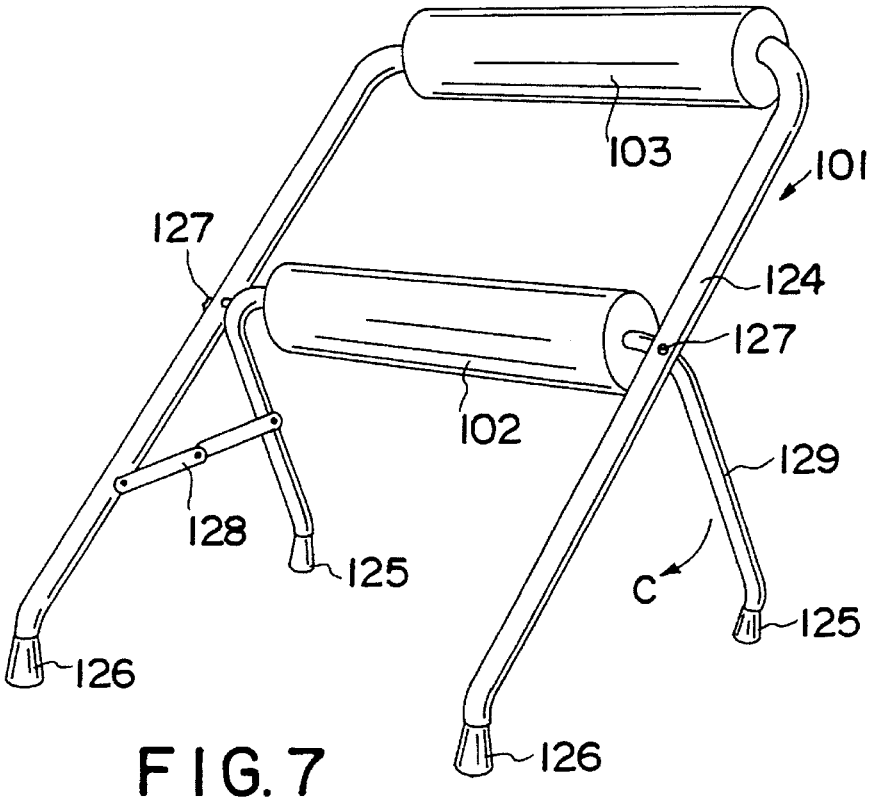
FIG. 7 shows an alternative, mobile embodiment of the shower seat of FIG. 4.

The shower seat 101 of FIG. 7 comprises a seat support roll 102 and a backrest roll 103, the seat support roll 102 being fitted on a tube 129 which is curved to a U-shaped tube, and which is provided with support caps 125 at both ends. The backrest roll 103 is fitted on a tube 130 which is curved to a U-shape, and which is provided with support caps 126 at both ends. The tubes 129 and 130 are connected to each other at the position of hinge pins 127, and are also connected to each other by means of a conventional collapsible hinge bar 128, so that the tube 129 can be turned relative to the tube 130 in the direction C, in order to collapse and store the shower seat 101.

We claim:

1. A shower sitting structure, which comprises:

a frame;

a seat mounted on said frame and comprised of user supporting portions spaced apart and disposed symmetrically with respect to a vertical plane, said user supporting portions merging into each other at said vertical plane, each user supporting portion supporting a user's thigh from a front support end to a rear support end thereof, said front support end disposed to lie proximate a user's knee, each user supporting portion extending to said user's buttock to a rear supporting end terminating short of said user's ischial tuberosities thereby forming an essentially free horizontal passage therebetween from front to back of user's perineum; and a back support element mounted to said frame having a back support surface for a back region proximate user's sacrum.

2. The shower sitting structure as defined in claim 1 wherein said rear support ends of said user supporting portions form an obtuse downward opening angle of 160°–180°.

3. The shower sitting structure as defined in claim 1 or 2 wherein said seat is essentially U-shaped with an opening portion proximate said user's buttock.

4. The shower sitting structure as defined in claim 1 and further including hinge means for folding said seat.

* * * * *